US008074400B2

(12) United States Patent
Speyer et al.

(10) Patent No.: US 8,074,400 B2
(45) Date of Patent: Dec. 13, 2011

(54) COMBINED MODULAR SEALING SYSTEMS AND SEAL ACTIVATION SYSTEM FOR DOOR/WINDOW

(75) Inventors: William Kip Speyer, Boca Raton, FL (US); Jonathan D. Thielmann, Delray Beach, FL (US); Robby A. Marsh, Fort Lauderdale, FL (US)

(73) Assignee: Secura-Seal Technologies LLC, Bensalem, PA (US)

( * ) Notice: Subject to any disclaimer, the term of this patent is extended or adjusted under 35 U.S.C. 154(b) by 846 days.

(21) Appl. No.: 11/756,948

(22) Filed: Jun. 1, 2007

(65) Prior Publication Data

US 2007/0289221 A1 Dec. 20, 2007

Related U.S. Application Data

(63) Continuation-in-part of application No. 11/425,386, filed on Jun. 20, 2006, now Pat. No. 7,627,987.

(51) Int. Cl.
*E06B 7/28* (2006.01)

(52) U.S. Cl. ..... 49/318; 49/303; 49/316; 49/317; 49/320; 49/321

(58) Field of Classification Search ..... 49/303, 49/306, 307, 308, 316, 317, 319, 320, 321
See application file for complete search history.

(56) References Cited

U.S. PATENT DOCUMENTS

| | | | |
|---|---|---|---|
| 19,217 | A | 1/1858 | Tinney |
| 724,139 | A | 3/1903 | Smith |
| 982,828 | A | 1/1911 | Kelly |
| 1,468,958 | A | 9/1923 | Champion |
| 1,675,230 | A | 6/1928 | Snyder |
| 1,715,188 | A | 5/1929 | Bullock |
| 1,797,839 | A | 3/1931 | Ramsay |
| 1,977,726 | A | 10/1934 | Jacobson |
| 1,995,939 | A | 3/1935 | Osten |
| 2,207,065 | A | 7/1940 | McCormick |
| 2,541,421 | A | 2/1951 | Hunter |
| 2,552,369 | A | 5/1951 | Currie |
| 2,628,678 | A | 2/1953 | Webster |
| 2,862,262 | A | 12/1958 | Shea |
| 2,928,144 | A | 3/1960 | Persson |

(Continued)

OTHER PUBLICATIONS

Dictionary.com, "Active," retrieved online at: http://dictionary.reference.com/browse/active (2010).

(Continued)

*Primary Examiner* — Jerry Redman
(74) *Attorney, Agent, or Firm* — Nelson Mullins Riley & Scarborough LLP; Anthony A. Laurentano

(57) ABSTRACT

A combination sealing system and seal activation system for use with a combination of a panel and a frame includes a plurality of sealing systems and a seal activation systems. Each of the sealing systems include an anchor, at least one movable member, and an actuator. The anchor engages one of the panel and the frame, and the anchor movable from a first position to a second position towards the panel. The at least one movable member is positioned in an other of the panel and the frame and moves the anchor between the first position and the second position. The actuator is connected to the at least one movable member and drives the at least one movable member. The seal activation system is connected to each of the actuators of the plurality of sealing systems.

19 Claims, 9 Drawing Sheets

U.S. PATENT DOCUMENTS 3,004,309 A 10/1961 Karodi
3,054,152 A 9/1962 Trammell
3,059,287 A 10/1962 Baruch
3,070,856 A 1/1963 Minick
3,077,644 A 2/1963 Kesling
3,098,519 A 7/1963 Myers
3,111,727 A 11/1963 Gerecke
3,126,051 A 3/1964 Sussin
3,163,891 A 1/1965 Seliger
3,184,806 A 5/1965 Bragman
3,289,377 A 12/1966 Hetman
3,295,257 A 1/1967 Douglass
3,335,524 A 8/1967 Carson
3,383,801 A 5/1968 Dallaire
3,466,801 A 9/1969 Bohn
3,512,303 A 5/1970 Wright
3,590,531 A 7/1971 Childs
3,660,936 A 5/1972 Bryson
3,660,940 A 5/1972 Tavano
3,816,966 A 6/1974 Sause, Jr.
3,818,636 A 6/1974 Calais et al.
3,821,884 A 7/1974 Walsh
3,848,908 A 11/1974 Rich
3,857,199 A 12/1974 Frach et al.
3,910,155 A 10/1975 Wilson
3,959,927 A 6/1976 Good
4,018,022 A 4/1977 Fink
4,027,431 A 6/1977 Rackard
4,064,651 A 12/1977 Homs
4,170,846 A 10/1979 Dumenil et al.
4,307,542 A 12/1981 Lense
4,317,312 A 3/1982 Heideman
4,322,914 A 4/1982 McGaughey
4,392,329 A 7/1983 Suzuki
4,413,446 A 11/1983 Dittrich
4,453,346 A 6/1984 Powell et al.
4,479,330 A 10/1984 Muller
4,496,942 A 1/1985 Matsuoka
4,535,563 A 8/1985 Mesnel
4,614,060 A 9/1986 Dumenil et al.
4,656,779 A * 4/1987 Fedeli ..... 49/318
4,716,693 A 1/1988 Webster
4,765,105 A 8/1988 Tissington et al.
4,768,316 A 9/1988 Haas
4,831,509 A 5/1989 Jones et al.
4,837,560 A 6/1989 Newberry
4,870,909 A 10/1989 Richter
4,936,049 A 6/1990 Hansen
5,007,202 A 4/1991 Guillon
5,020,292 A 6/1991 Strom et al.
5,029,911 A 7/1991 Daniels
5,030,488 A 7/1991 Sobolev
5,187,867 A 2/1993 Rawlings
5,293,726 A 3/1994 Schick
5,327,684 A 7/1994 Herbst
5,339,881 A 8/1994 Owens
5,349,782 A 9/1994 Yulkowski
5,379,518 A 1/1995 Hopper
5,446,997 A 9/1995 Simonton
5,467,559 A 11/1995 Owens
5,479,151 A 12/1995 Lavelle et al.
5,511,833 A 4/1996 Tashman et al.
5,521,585 A 5/1996 Hamilton
5,522,180 A 6/1996 Adler et al.
5,522,195 A 6/1996 Bargen
5,569,878 A 10/1996 Zielinski
5,584,142 A 12/1996 Spiess
5,605,013 A 2/1997 Hogston
5,870,859 A 2/1999 Kitada
5,870,869 A 2/1999 Schrader
5,964,060 A 10/1999 Furlong
6,041,552 A 3/2000 Lindahl
6,057,658 A 5/2000 Kovach et al.
6,082,047 A 7/2000 Comaglio et al.
6,105,313 A 8/2000 Holloway et al.
6,112,466 A 9/2000 Smith et al.
6,112,467 A 9/2000 Bark et al.
6,112,496 A 9/2000 Hugus et al.
6,170,195 B1 1/2001 Lim
6,173,533 B1 1/2001 Cittadini et al.
6,181,089 B1 1/2001 Kovach et al.
6,202,353 B1 3/2001 Giacomelli
6,218,939 B1 4/2001 Peper
6,243,999 B1 6/2001 Silverman
6,289,643 B1 9/2001 Bonar
6,318,037 B1 11/2001 Hansen
6,442,899 B1 9/2002 Gledhill
6,490,832 B1 12/2002 Fischbach et al.
D470,252 S 2/2003 Castrey
6,546,682 B1 4/2003 DeBlock et al.
6,553,735 B1 4/2003 Wang Chen
6,568,131 B1 5/2003 Milano, Jr.
6,619,005 B1 9/2003 Chen
6,644,884 B2 11/2003 Gledhill
6,651,389 B2 11/2003 Minter et al.
6,772,818 B2 8/2004 Whitley et al.
6,786,005 B1 9/2004 Williams
6,871,902 B2 3/2005 Carson et al.
6,973,753 B2 12/2005 Liebscher
7,010,888 B2 3/2006 Tumlin et al.
7,145,436 B2 12/2006 Ichikawa et al.
7,185,468 B2 3/2007 Clark et al.
7,487,616 B2 2/2009 Deaver
7,566,035 B2 7/2009 Bonshor
7,719,213 B2 5/2010 Herman et al.
2003/0033786 A1 2/2003 Yulkowski
2004/0068935 A1 4/2004 Ichikawa et al.
2005/0097842 A1 5/2005 Arcamonte et al.
2005/0102908 A1 5/2005 Martin
2006/0207199 A1 9/2006 Darnell
2007/0289221 A1 12/2007 Speyer et al.
2009/0165415 A1 7/2009 Salerno
2009/0165423 A1 7/2009 Salerno

OTHER PUBLICATIONS

Patio Life—Operation, retrieved online at: http://www.rotohardware.com/Products/Patio%20Life/PL-Operation.htm (2006).

International Search Report for Application No. PCT/US2010/029383, dated May 25, 2010.

International Search Report for Application No. PCT/US2010/029206, dated Jun. 2, 2010.

* cited by examiner

COMBINED MODULAR SEALING SYSTEMS AND SEAL ACTIVATION SYSTEM FOR DOOR/WINDOW

CROSS-REFERENCE TO RELATED APPLICATIONS

This application is a Continuation-In-Part of U.S. Appl. No. 11/425,386, now U.S. Pat. No. 7,627,987, filed on Jun. 20, 2006 and issued on Dec. 8, 2009, incorporated herein by reference in its entirety.

BACKGROUND OF THE INVENTION

1. Field of the Invention

The disclosure relates generally to sealing systems for use with panels, such as a door or a window, within a frame and, more specifically, to a sealing system for providing an improved seal between a panel and frame.

2. Description of the Related Art

Certain types of panels, such as doors and windows, are positioned within openings of a wall and/or other structures using a frame. These panels may also open and close by pivoting relative to the frame. Alternatively, the one or more panel may slide relative to the frame. An issue associated with these types of panels is the integrity of the seals between the panels and the frame. In many instances, these seals are an insufficient barrier in preventing the transfer of such environmental elements as noise, weather, water, and insects from one side of the panel to the other side of the panel.

Attempts have been made to address these issues by using various types of weather stripping between the panels and frame. For example, the weather stripping may be strip of felt, foam, or a pile of flexible synthetic material. In many instances, however, this weather stripping fails to act as a sufficient seal between the panels and frame. Another issue prevalent associated with the seals between a frame and panel or between adjacent panels is that these seals can become disjoined. Either intentionally or unintentionally, the alignment between the frame and panel or between adjacent panels may be disturbed which can degrade the quality of the seal, since, in many instances, the integrity of the seal relies upon these members having certain positional relationships relative to one another.

Another issue associated with the movement of one or more panels relative to the frame is structural integrity and/or security of the panels relative to the frame. While in certain circumstances, allowing the panel to move relative to the frame is desirable, in other circumstances, not allowing the panel to move relative to the frame is desirable for the purpose of preventing undesired access through the panel. Means for providing these separate functionalities, however, can be incompatible with one another, and the means employed to provide both functions often involve tradeoffs that reduce the effectiveness of both functions.

There is, therefore, also a need for a sealing system that effectively allows both a panel to move relative to the frame and also to selectively prevent movement of the panel relative to the frame. There is also a need for a sealing system that can be employed between a frame and panel that prevents the transfer from one side of the panel to the other side of the panel such environmental effects as noise, weather, water, heat/cold, and insects.

BRIEF SUMMARY OF THE INVENTION

Embodiments of the invention address deficiencies of the art with respect to effectively creating a seal between a panel and a frame. In this regard, a combination sealing system and seal activation system for use with a combination of a panel and a frame includes a plurality of sealing systems and a seal activation system. Each of the sealing systems include an anchor, at least one movable member, and an actuator. The anchor engages one of the panel and the frame, and the anchor movable from a first position to a second position towards the panel. The at least one movable member is positioned in an other of the panel and the frame and moves the anchor between the first position and the second position. The actuator is connected to the at least one movable member and drives the at least one movable member. The seal activation system is connected to each of the actuators of the plurality of sealing systems.

In certain aspects of the combined sealing system and seal activation system, the plurality of sealing systems and the seal activation system are positioned within the frame, and the panel pivots relative to the frame. The plurality of sealing systems include a first sealing system positioned along a first side of the frame; and a second sealing system positioned along a second side of the frame. The first side of the frame is substantially perpendicular to the second side of the frame. A transfer system is positioned between the first sealing system and the second sealing system, and the transfer system transfers motion from the actuator of the first sealing system to the actuator of the second sealing system.

In other aspects of the combined sealing system and seal activation system, the first sealing system is connected to a first anchor, and the second sealing system is connected to a second anchor. One of the first sealing system and the second sealing system includes a corner adaptor, and in an engaged configuration of the seal activation system, the corner adaptor forms a seal between the first anchor and the second anchor. In an engaged configuration of the seal activation system, the anchor of each of the plurality systems respectively extends into one or more slots within the panel to prevent movement of the panel relative to the frame.

In further aspects of the combined sealing system and seal activation system, the seal activation system includes a control member and a pair of opposing slides. Movement of the control member along a first axis moves the opposing slides along a second axis different than the first axis. The opposing slides are respectively attached to the actuator of a first sealing system and the actuator of a second sealing system; and the first and second sealing systems positioned on a same side of the frame.

In yet other aspects of the combined sealing system and seal activation system, at least two of the plurality of sealing systems share a common anchor. In an engaged configuration of the seal activation system, the anchor of each of the plurality of sealing systems engages one of the panel and frame to form a seal between the panel and the frame. One of the control member and the pair of opposing slides includes a pair of slots not parallel to the first or second axis and the other of the control member, and the pair of opposing slides includes a pair of pin respectively extending through the pair of slots. A drive systems moves the control member.

In another embodiment of the combined sealing system and seal activation system, the combination sealing system and seal activation system includes first, second, and third sealing systems; a transfer device, and a seal activation system. The first and second sealing systems are positioned in a first side of the frame. The third sealing system is positioned in a second side of the frame. The transfer device is positioned between and connected to the second sealing system and the third sealing system. The seal activation system is positioned between and connected to the first and second sealing systems. Each of the first, second, and third sealing systems include an anchor, at least one movable member, and an actuator. The anchor engages the panel, and the anchor is movable from a first position to a second position towards the panel. The at least one movable member is positioned in the frame and moves the anchor between the first position and the second position. The actuator is connected to the at least one movable member and drives the at least one movable member. The seal activation system is directly connected to the actuators of the first and second sealing systems. The transfer system transfers motion from the actuator of the second sealing system to the actuator of the third sealing system. The first and second sealing systems share a common anchor.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1:
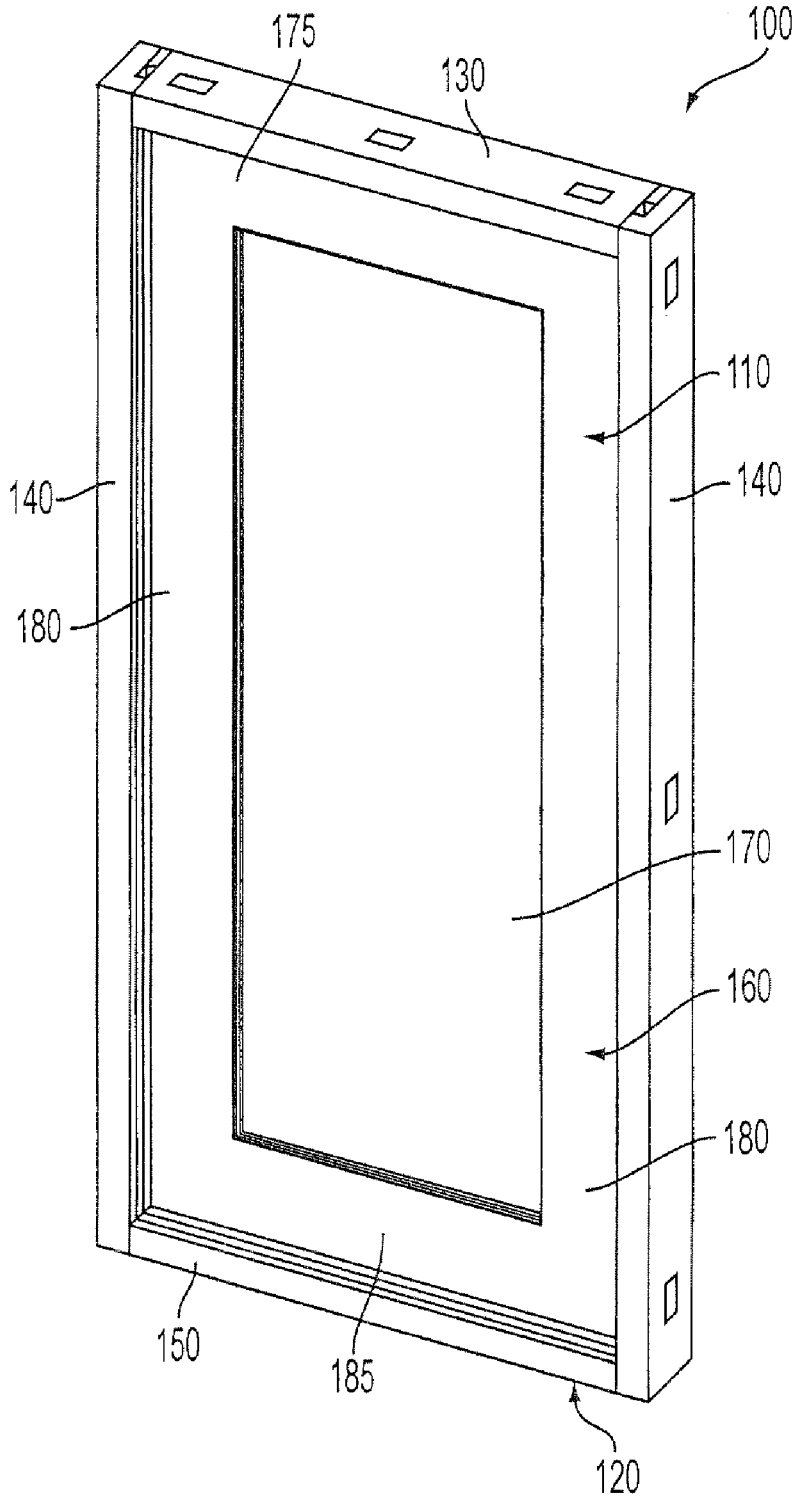
FIG. 1 is a perspective view of a door/window system in a closed position in accordance with the inventive arrangements.
Figure 2C:
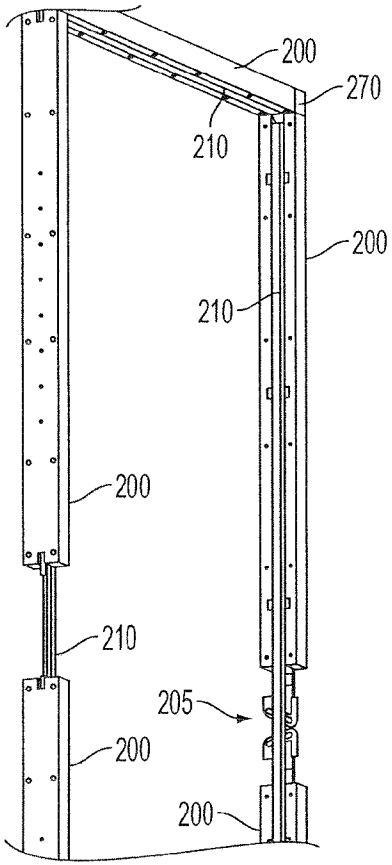
FIGS. 2A-2C are partial, perspective views of multiple sealing system modules in accordance with the inventive arrangements, respectively, in unlocked, partially engaged, and locked configurations.
Figure 2B:
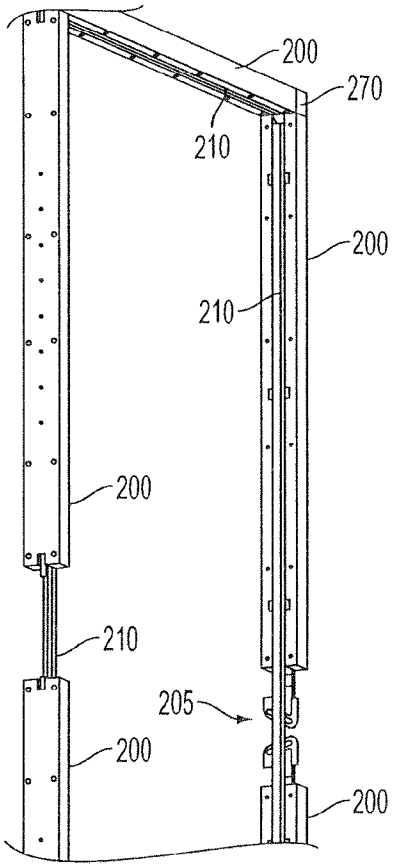
Figure 2A:
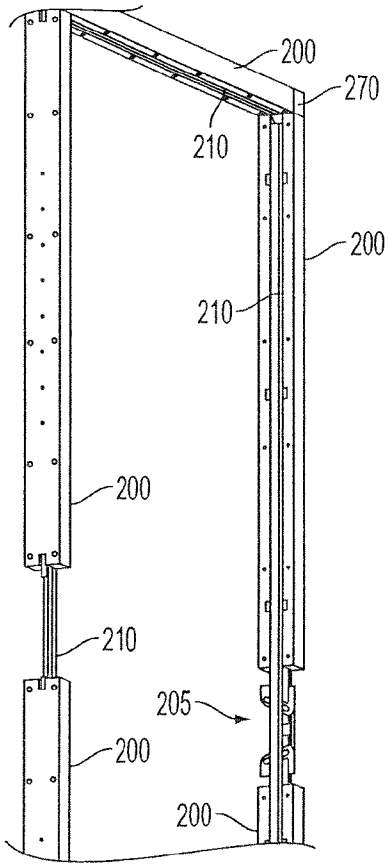

FIG. 1 illustrates an exemplar door/window system 100 for use with the combination sealing system 200 and seal activation system 205. The combination sealing system 200 and seal activation system 205 can be used with many types of doors and/or windows, and the combination sealing system 200 and seal activation system 205 is not limited to the particular door/window system 100 illustrated. For example, the combination sealing system 200 and seal activation system 205 may be used with pocket doors, sliding doors, French doors, entry doors, garage doors, sliding windows, single-hung windows, double-hung windows, casement windows, and awning windows. The door/window system 100 includes at least one panel 110 connected to a stationary frame 120. Although not limited in this manner, the panel 110 may pivot relative to the frame 120.

The frame 120 may include a header 130, jambs 140, and a sill 150. A header 130 is a structural member that spans an upper portion of the window/door opening. Jambs 140 are the outermost vertical side members of the frame 120. A sill 150 is a threshold or structural member that spans a lower-most portion of the window/door opening. As recognized by those skilled in the art, different terms may also be associated with the above-structure identified as the header 130, jambs 140, and sill 150.

The panel 110 may include a sash 160 that surrounds a pane 170. The pane 170 is not limited as to a particular material. For example, the pane 170 may be translucent, such as glass or plastic, opaque, such as with wood or metal, or any combination thereof. The sash may include a header rail 175, jamb or stile rails 180, and a sill rail 185. As recognized by those skilled in the art, different terms may also be associated with the structure identified as the header rail 175, the jamb or stile rail 180, and sill rail 185.

The sealing system 200 (see FIGS. 2A-2C, 4A-4C, 8A-8C) may be used with each of the members 175, 180, 185 of the sash 160 to form a seal between each pair of adjacent surfaces of the sash 160 of the panel 110 and the frame 120. In this manner, each of the separate sides of the panel 110 may employ the sealing system 200. As will be described in more detail below, not only does the sealing system 200 provide at least one seal between adjacent members of sash 160 and frame 120, each of the sealing systems 200 may be configured to prevent the movement of the panel 110 relative to the frame 120. In so doing, the sealing systems 200 can act as a lock and/or security device that prevents the forced opening of the panel 110 relative to the frame 120. Many types of sealing systems 200 so capable are known in the art, and the present door/window system 100 is not limited as to a particular type of sealing system 200.

Additionally, although the present door/window system 100 is described herein with particular types of sealing systems 200 being positioned in particular locations, the door/window system 100 is not limited as to a particular type of sealing system 200 or a particular location of the sealing system 200. For example, a sealing system 200 may be positioned within the frame 120 and/or the sash 160. However, in certain aspects of the door/window system 100, the sealing systems 200 are positioned within the frame 120.

To prevent the forced opening of the panel 110, the sealing systems 200 are not limited as to a percentage of coverage between particular members of the frame 120 and/or panel 110. For example, the sealing systems 200 may only cover a fractional number (e.g., 10%, 50%, 85%) of the length between particular members of the frame 120 and/or panel 110. However, in certain aspects, the sealing systems 200 provide substantially complete coverage between the sash 160 of a panel 110 and the frame 120. In so doing, the combined sealing systems 200 can provide a seal substantially, completely around the panel 110.

Referring to FIGS. 2A-2C and 3A-3B, a combination of sealing systems 200 is disclosed. In certain aspects of the door/window system 100, a plurality of identical or nearly identical sealing system modules 200 are used to provide substantially complete coverage between the sash 160 of a panel 110 and the frame 120. In so doing, the same type of sealing system module 200 is located on at least two sides of the frame/sash 120/160 (hereinafter referred to as the frame 120). In other aspects, more than one of the same type of sealing system module 200 is located on a single side of the frame 120. Still further, in other aspects, at least one sealing system module 200 of the same type is located on each side of the frame 120.

Although not limited in this manner, for those sides of the frame 120 that include multiple sealing system modules 200, the multiple sealing systems 200 may be each connected to a single anchor 210, which is used in forming the seal between the panel 110 and frame 120. The anchor 210 may be connected to movable members 225 of (see FIGS. 4A-4C) each of the multiple sealing system modules 200, and via coordinated movement of movable members 225, the multiple sealing system modules 200 cause the anchor 210 to move from a disengaged/unlocked position (e.g., FIG. 2A) to an engaged/locked position (e.g., FIG. 2C).

The multiple sealing system modules 200 may also be interconnected such that upon one of the sealing system modules 200 being engaged, additional sealing system modules 200 engage. A transfer system 270 (described with regard to FIGS. 8A-8C and 9) may be used to transfer motion of a member in one of the sealing system modules 200 to another member in a different one of the sealing system modules, and in this manner, the engagement of one of the sealing systems modules 200 can cause an additional sealing system modules 200 to engage. Moreover, the sealing system modules 200 may be connected in series such that the engagement of a single sealing system module 200 can cause multiple sealing system modules 200 to engage.

As noted above, each of the sealing system modules 200 may be substantially identical. In so doing, a single type of module can be used on multiple or all sides of the door/window system 100. This may allow for ease of manufacturing since multiple types of modules increase the complexity of the manufacturing process. Moreover, the use of a single type of module may allow for easier and/or less-expensive repair of the door/window system since it may be easier and/or less-expensive to replace a single sealing system module 200 as compared to a sealing system that spans a greater portion of the door/window system 100.

Although each of the sealing system modules 200 may be substantially identical, depending upon the location of a particular sealing system module 200 within the door/window system 100, modifications to the particular sealing system 200 can be contemplated. For example, a corner member 295 (see FIGS. 4A-4C, 8A-8C, and 9) may be attached to an end of an anchor 210, and the corner member 295 can act to create a seal between a pair of adjacent anchors 210.

Additionally, the transfer system 270 may be removably attached to an end of a particular sealing system module 200. For example, the transfer system 270 may be attached to pairs of adjacent sealing system modules 200 in which motion of one member in one of the sealing system modules 200 to another member in a different one of the sealing system modules 200. This occurs, for example, at the corners of the door/window system 100. These additional features that can be added to a particular sealing system module 200 add flexibility to the combined system of sealing system modules 200.

Figure 3A:
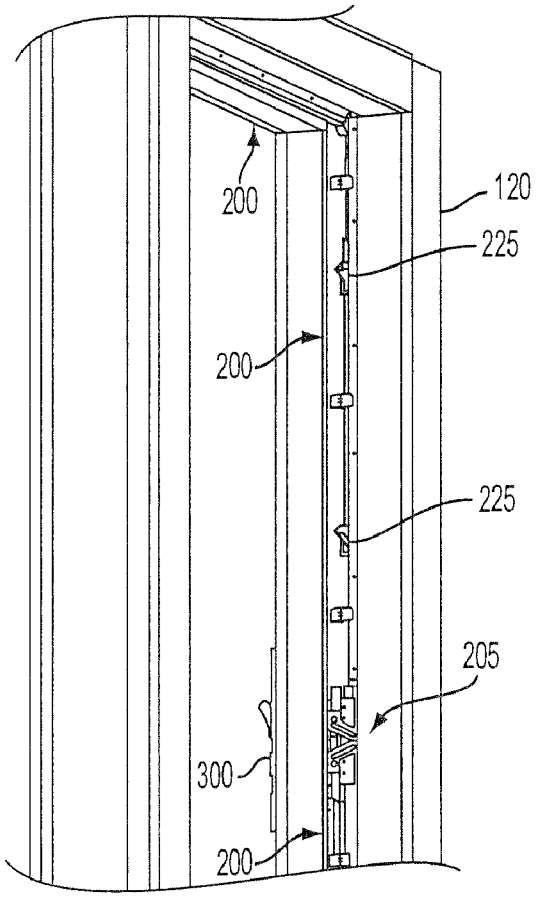
FIGS. 3A-3B are partial, perspective views of the multiple sealing system modules of FIGS. 2A-2C within a frame of the door/window system, respectively, without and with a facing covering the sealing system modules.
Figure 3B:
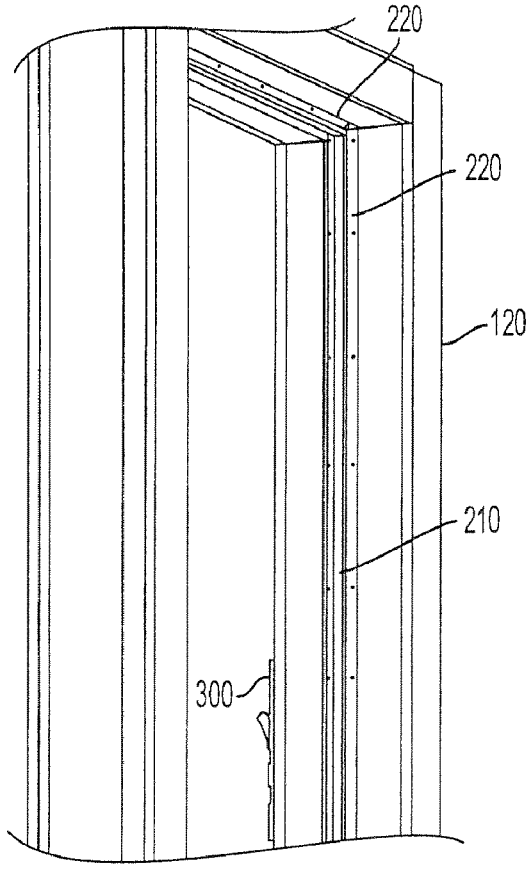
Figure 4A:
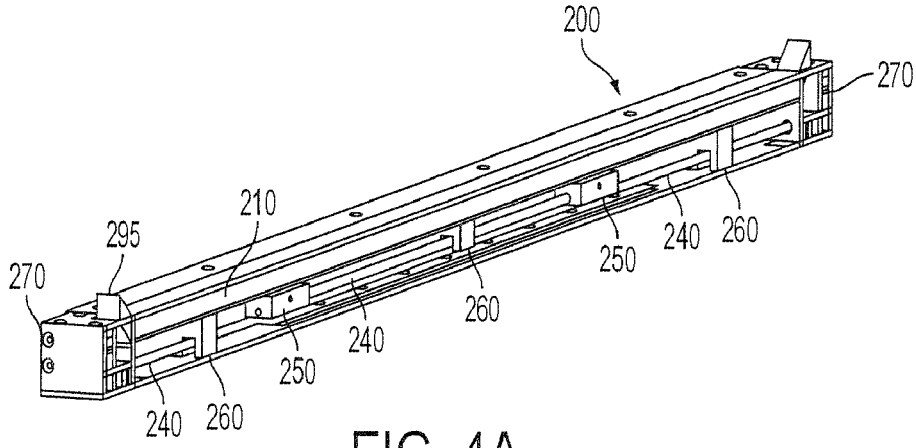
FIGS. 4A-4C are perspective views of an individual sealing system module in accordance with the inventive arrangements, respectively, in the unlocked, partially engaged, and locked configurations.
Figure 4B:
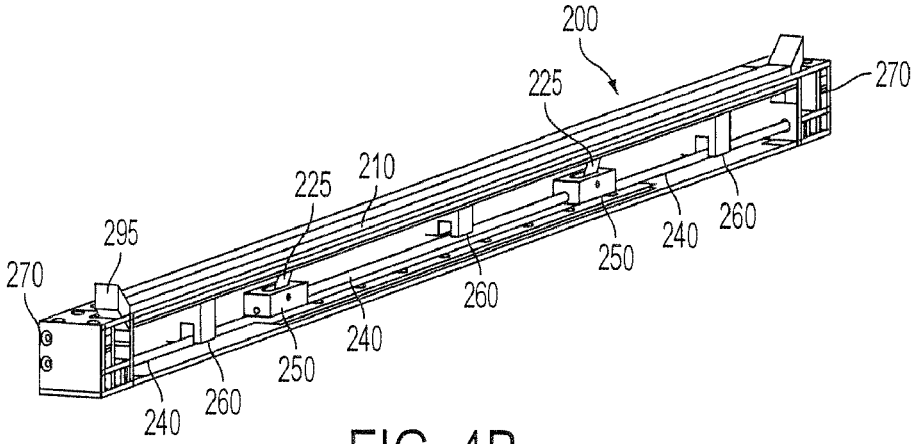
Figure 4C:
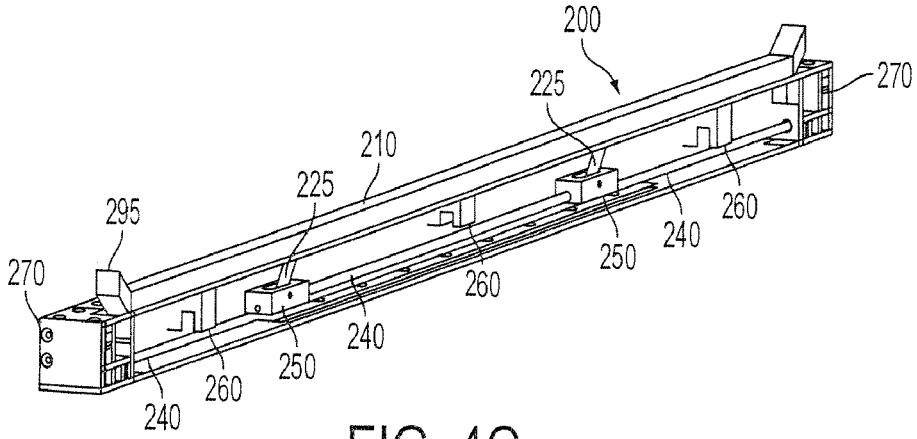
Figure 5A:
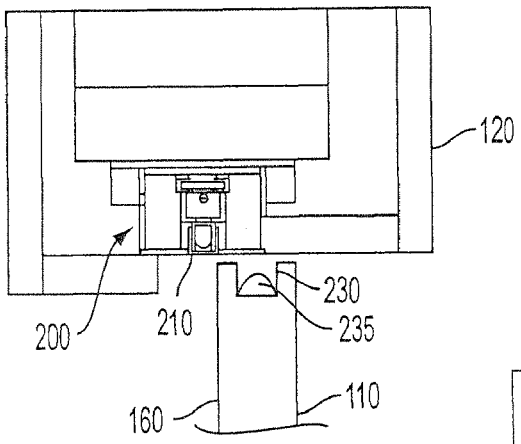
FIGS. 5A-5D are side views of a sealing system adjacent a panel in accordance with the inventive arrangements, respectively, in an open, closed and unlocked, partially engaged, and locked configurations.
Figure 5B:
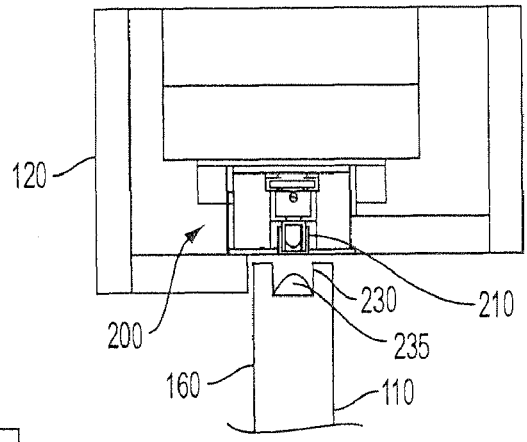
Figure 5C:
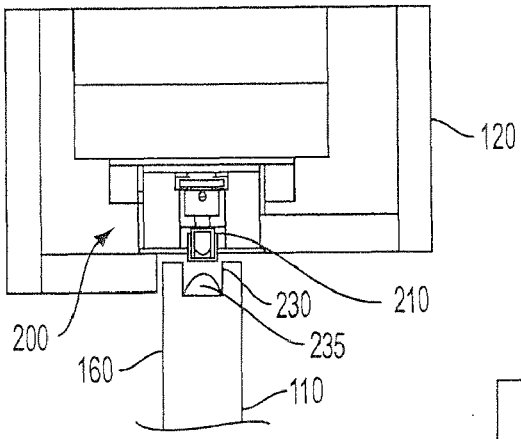
Figure 5D:
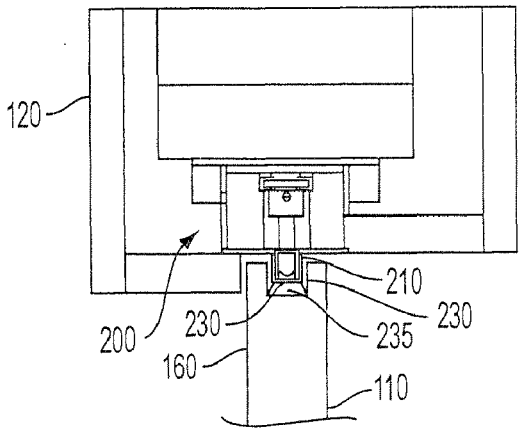

Referring to FIGS. 3A and 3B, facing 210 can be positioned over and removably attached to one or more of the individual sealing system modules 200. In so doing, the use, on a single side, of multiple sealing system modules 200 can be hidden. Moreover, the removably attachable facing 210 allows access to the sealing system modules 200 for subsequent repairs, adjustment, and/or replacement of the sealing system modules 200.

Referring to FIGS. 4A-4C and 5A-5D, a sealing system 200 for use in the door/window system 100 is illustrated. In certain aspects of the sealing system 200, the sealing system 200 drives an anchor 210 to form a seal 230 (see FIG. 5D) between adjacent members of sash 160 and the frame 120. The seal 230 is formed by engagement of the anchor 210 positioned on one of the frame 120 and sash 160 with another feature positioned on the other of the frame 120 and sash 160. However, in certain aspects of the sealing system 200, the anchor 210 is disposed in the frame 120 and engages a portion of the sash 160 of the panel 110. The sealing system 200 may also include one or more transfer systems 270 that connect the sealing system 200 to a seal activation system 205 (discussed within regard to FIGS. 6A-6C) and/or other sealing systems 200 (see discussion with regard to FIGS. 8A-8C and 9).

The sealing system 200 is not limited as to the particular portion of the sash 160 with which the anchor 210 engages to form the seal 230. However, in certain aspects of the sealing system 200, the anchor 210 engages a portion of a channel 240 within members (e.g., header rail 175, stile rail 180, and sill rail 185) of the sash 160.

By having the anchor 210 being positioned within the channel 240, movement of the panel 110 relative to the frame 120 in a direction not parallel to the direction of the movement of the anchor 210 can be prevented. Moreover, in certain aspects, movement of the panel 110 relative to the frame 120 in a direction substantially perpendicular to the direction of movement of the anchor 210 can be prevented. In so doing, movement of the panel 110 relative to the frame 120 (via, for example, a forced entry) creates a force, against the anchor 210, having a minimal vector in the direction in which the anchor 210 moves. Thus, this forced movement of the panel 110 relative to the frame 120 has a reduced likelihood in forcing the anchor 210 to move, thereby increasing the security of the door/window system 100.

The anchor 210 may directly engage a portion of the channel 240. Alternatively, the anchor 210 may include a sealing member (not shown) that engages a portion of the channel 240 and/or engage a sealing member 235 within the channel 240. The sealing member retards the movement of air, water, etc. and/or noise across the seal, and any sealing member so capable is acceptable for use in the sealing system 200. However, in certain aspects of the sealing system 200, the sealing members 235 are formed from a compressible material, such as foam.

Many types of devices are known as being capable of moving the anchor 210 to engage the panel 110, and the sealing system 200 is not limited as to a type of device so capable. However, in certain aspects of the sealing system 200, the anchor 210 is attached to one or more movable members 225. The movable member 225 moves between a first position and a second position relative to the frame 120, and movement of the movable member 225 from the first position to the second position causes the anchor 210 to move from a disengaged/unlocked position (e.g., FIGS. 2A, 4A, 5A) to an engaged/locked position (e.g., FIGS. 2C, 4C, 5C).

The sealing system 200 is not limited in the manner in which the movable member 225 is driven from the first position to the second position and back again. Many types of devices are known that are capable of transferring movement from one member to another member and the sealing system 200 is not limited in a device so capable. However, in certain aspects of the sealing system 200, the movement of the movable member 225 is driven by the back and forth motion of an actuator 240 that extends along a length of the sealing system 200.

A transfer device 250 transfers the back and forth motion of the actuator 240 to the movable member 225 thereby moving the anchor from the disengaged/unlocked position to the engaged/locked position and back again. Many types of devices are capable of transferring motion along one direction to another direction, and the transfer device 250 is not limited to any type of device so capable.

The sealing system 200 may also include supports 260 that are connected to the anchor 210. The supports 260 may be attached to an underside of the anchor 210 and positioned within the body of the sealing system 200. The supports 260 span the inner width of the body of the sealing system 200 and provide lateral stability to the anchor 210. The supports 260 may also act to limit the movement of the anchor 210 in one or multiple directions.

Figure 6A:
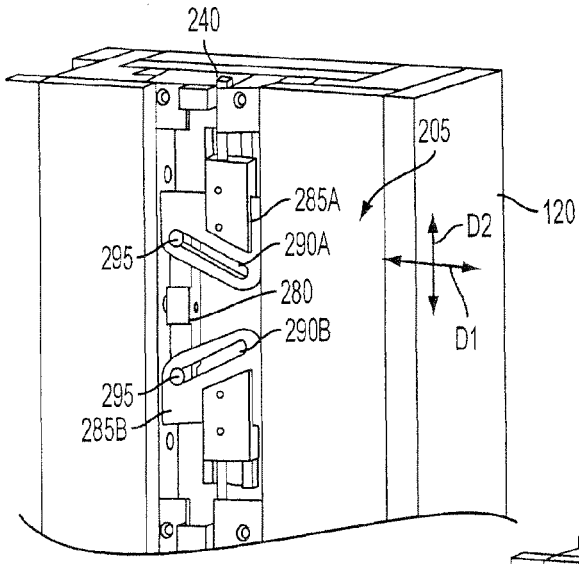
FIGS. 6A-6C are perspective views of a seal activation system in accordance with the inventive arrangements, respectively, in the unlocked, partially engaged, and locked configurations.
Figure 6B:
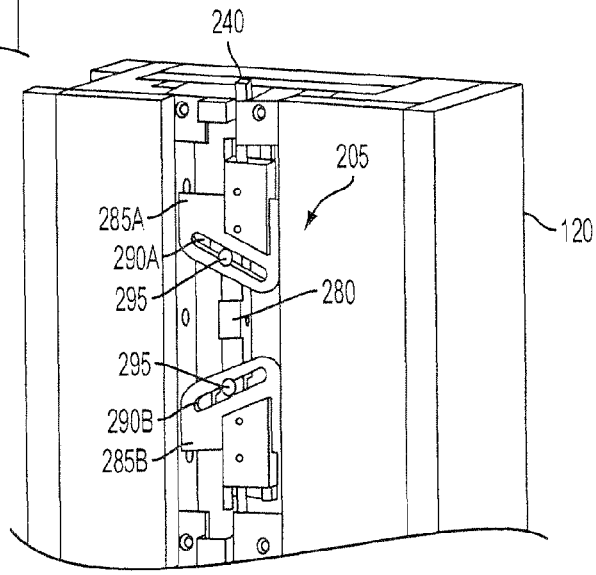
Figure 6C:
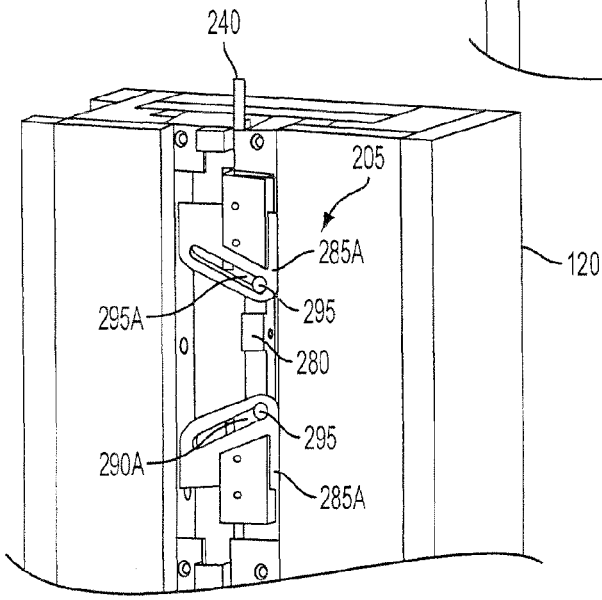

Referring to FIGS. 6A-6C, a seal activation system 205 for use in the door/window system 100 is illustrated. The seal activation systems 205 may be positioned within the header 130, jambs 140, and/or sill 150 of the frame 120. In certain aspects of the door/window system 100, the seal activation system 205 may interact with one or more sealing systems 200 within the frame 120. These sealing systems 200, in turn, may interact with the panel 110 to provide at least one seal 230 between adjacent members of the sash 160 of the panel 110 and the frame 120 in a locked configuration, and/or the sealing system 200 may interact with the panel 110 to prevent the movement of the panel 110 relative to the frame 120 in the locked configuration. In an unlocked configuration, the sealing system 200 may not provide the seal 230 and/or prevent movement of the panel 110 relative to the frame 120. Many types of seal activation system 205 capable of this type of interaction with a sealing system 200 are known in the art, and the present door/window system 100 is not limited as to a particular type of seal activation system 205 so capable.

In certain aspects of the seal activation system 205, the seal activation system 205 transfers motion along a first axis D1 to motion along a second axis D2. Although not limited in this manner, the first axis D1 is substantially perpendicular to the second axis D2. Many types of devices are known that are capable of transferring motion from one member to another member and the door/window system 100 is not limited in a device so capable. However, in certain aspects of the seal activation system 205, the seal activation system includes a control member 280 that moves along the first axis D1, which is connected to a pair of opposing slides 285A, 285B that move along the second axis D2.

The control member 280 includes pins 295 that extend through slots 290A, 290B, respectively in each of the opposing slides 285A, 285B. The slots 290A, 290B are not parallel relative to the first and second axis D1, D2 such the distance between from one slot 290A to the other slot 290B varies along the length of the slots 290A, 290B. The pins 295 are at a fixed distance relative to one another such that movement of the control member 280 changes the distance between the opposing slides 285A, 285B. In the manner, movement of the control member 280 along the first axis D1 is translated into movement of the opposing slides 285A, 285B along the second axis D2.

Although the pins 295 are shown positioned within the control member 280 and the slots 290A, 290B are within the slides 285A, 285B, the seal activation system 205 is not limited in this manner. For example, the pins 295 can be located respectively in each of the slides 285A, 285B, and the slots 290A, 290B may be positioned within the control member 280.

The slides 285A, 285B, are connected to at least one actuator 240. However, in certain aspects of the seal activation system 205, the slides are each respectively connected to an actuator 240. The motion of the slides 285A, 285B along the second axis D2 is thus transferred to the actuators 240, and as previously discussed, the motion of the actuators 240 drive the movement of the anchors 210.

Figure 7:
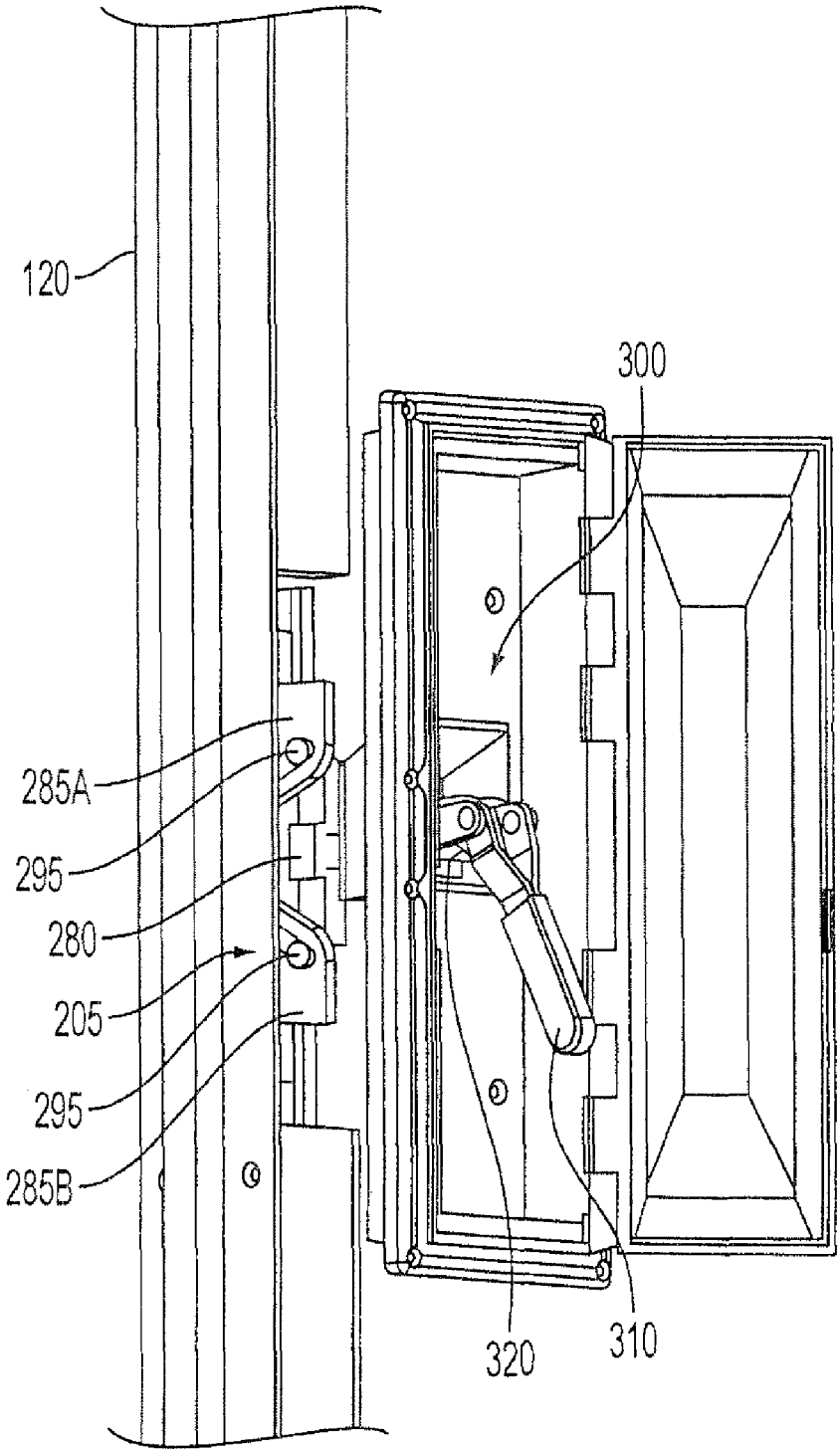
FIG. 7 is a perspective view of a drive system within a frame for driving the sealing activation system in accordance with the inventive arrangements.
Figure 8A:
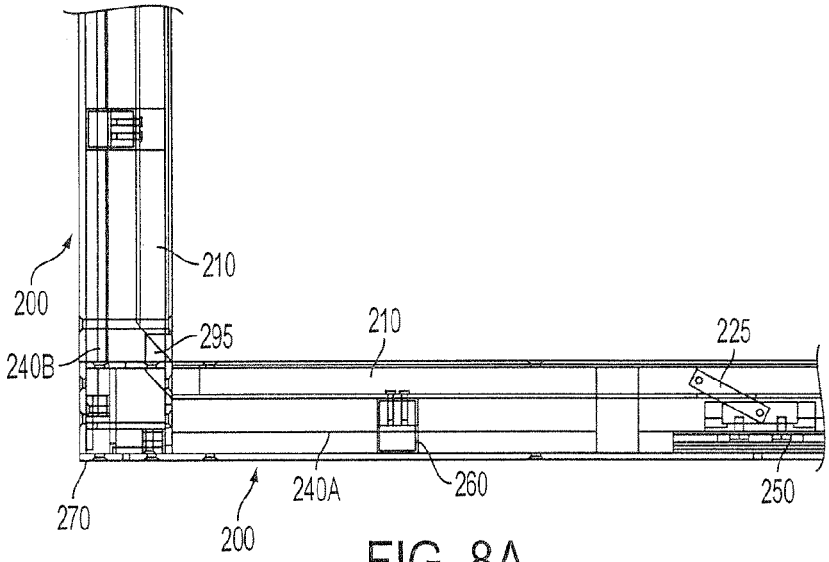
FIGS. 8A-8C are side views of adjacent sealing system modules in accordance with the inventive arrangements, respectively, in the unlocked, partially engaged, and locked configurations.
Figure 8B:
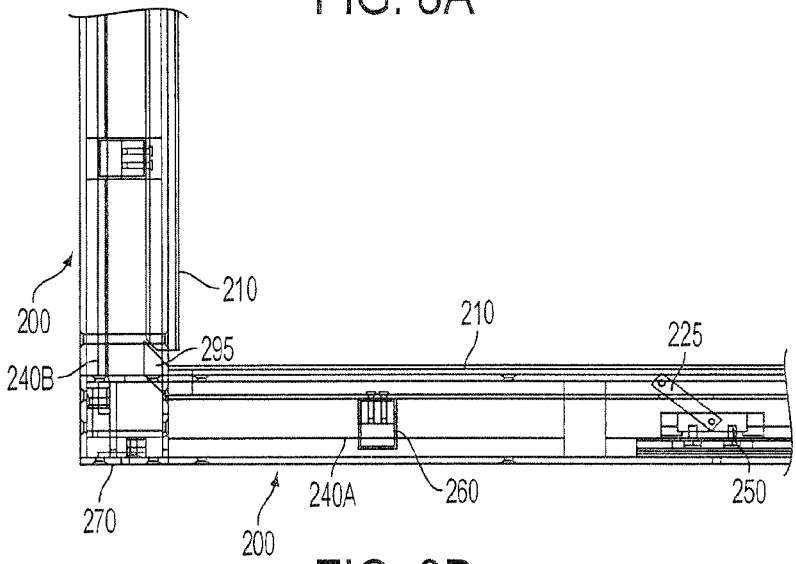
Figure 8C:
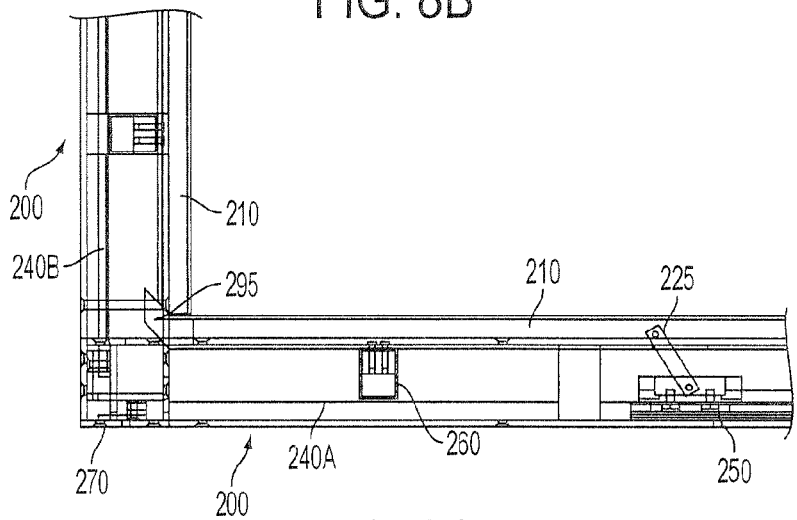
Figure 9:
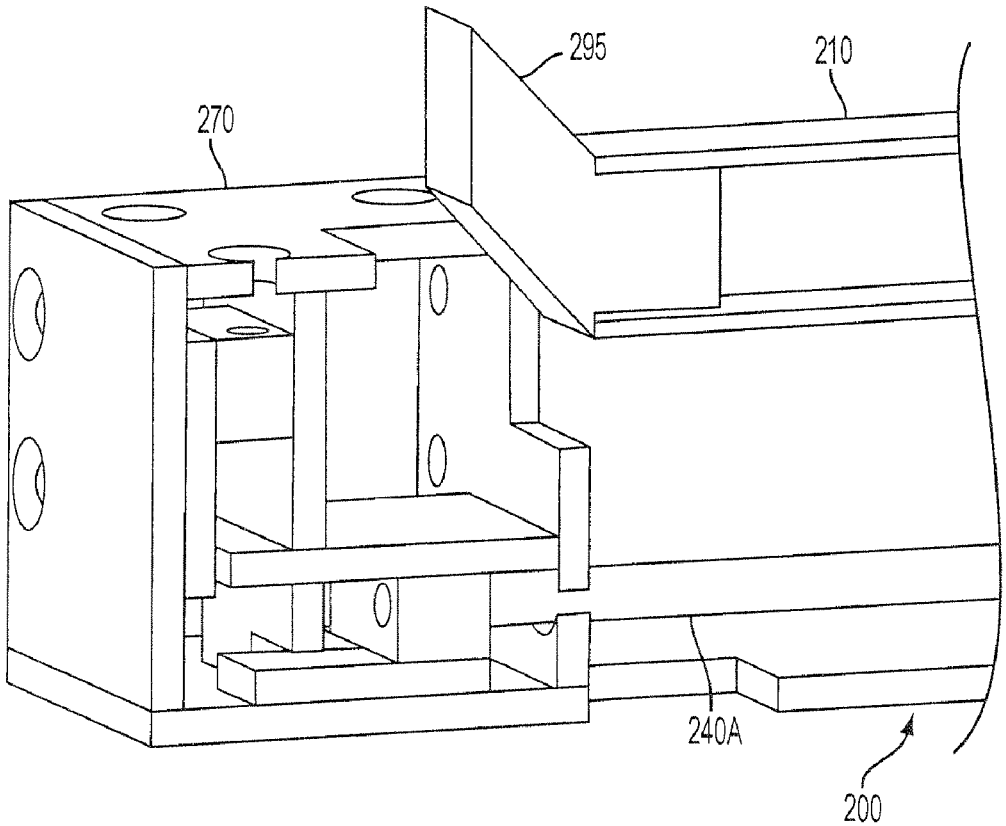
FIG. 9 is a perspective view of a transfer system and adjacent sealing system module in accordance with the inventive arrangements.

Referring to FIG. 7, a drive system 300 for use in the door/window system 100 is illustrated. The drive system 300 moves the seal activation system 205 from an deactivated/unlocked configuration (e.g., FIGS. 2A, 6A) to an activated/locked configuration (e.g., FIGS. 2C, 6C) thereby driving the sealing system 200 from an deactivated/unlocked configuration to an activated/locked configuration. The drive system 300 may also move the seal activation system 205 from the activated/locked configuration to the deactivated/unlocked configuration. In certain aspects, the drive system 300 is configured to simultaneously drive each of the separate sealing systems 200. In other aspects of the door/window system 100, however, multiple drive systems 300 may be provided to separately close one or multiple sealing systems 200.

How the drive system 300 moves the seal activation system 205 from the deactivated/unlocked configuration to the activated/locked configuration (and back again) is not limited as to a particular manner and/or device. As can be readily envisioned, the configuration and operation of the drive system 300 may be determined by the configuration and operation of the seal activation system 205. A present example of the sealing system 300 employs the use of a handle 310 that pulls/pushes on a connecting member 320 that is attached to the control member 280 of the seal activation system 205. This pulling/pushing motion creates the back and forth movement along axis D1 of the control member 280. Although the illustrated drive system 300 is shown as being driven with a manual device, other devices capable of driving a sealing system 200 are commonly known, such as a magnetic, mechanical, and electromechanical devices.

Although not limited to this configuration, by positioning the sealing systems 200, seal activation system 200, and the drive system 300 all within the frame 120 of the door/window system 100, no moving parts need be positioned within the panel 100.

Referring to FIGS. 8A-8C and 9, a transfer system 270 for use in the door/window system 100 is illustrated. The transfer system 270 transfers motion, such as linear back and forth motion, from one actuator 240A to another actuator 240B. In so doing, the motion generated by a single seal activation system 205 is capable of driving two or more sealing systems 200 located on different edges of the frame 120 and sash 160 through the use of one or more transfer systems 270. Alternatively or, in addition to a single seal activation system 205 driving two or more sealing systems 200, as previously discussed, multiple seal activation systems 205 can each separately drive one or more sealing systems 200.

Many types of transfer systems 270 are capable of transferring motion from one actuator 240A to another actuator 240B, and the door/window system 100 is not limited as to transfer system 290 so capable. For example, the transfer system 270 may include a set of inter-engaging gears respectively attached to the actuators 240A, 240B to transfer linear motion from one actuator 240A to the other actuator 240B. In certain aspects, however, the motion is transferred using a flexible strap (not shown) that is curved by a corner guide (not shown) within the transfer system 270 and respectively attached to both of the actuators 240A, 240B.

What is claimed is:

1. A sealing system for providing a seal between a panel and a frame, the sealing system comprising:

a frame;

a panel coupled to the frame;

a plurality of sealing modules provided along the frame to form a sealing mechanism, each of the plurality of sealing modules including:

an anchor for engaging the panel or the frame, the anchor movable from a first position to a second position towards the panel, at least one movable member, positioned in the panel or the frame, for moving the anchor between the first position and the second position, and an actuator connected to the at least one movable member and for driving the at least one movable member, the actuator moving in a direction perpendicular to a moving direction of the anchor; and a seal activation system connected to each of the actuators of the plurality of sealing modules, wherein at least two sealing modules are provided in series along a vertical side of the frame.

2. The sealing system of claim 1, wherein the plurality of sealing modules and the seal activation are positioned within the frame.

3. The sealing system of claim 2, wherein the panel pivots relative to the frame.

4. The sealing system of claim 2, wherein the plurality of sealing modules include a first sealing module positioned along a first side of the frame; and a second sealing module positioned along a second side of the frame.

5. The sealing system of claim 4, wherein the first side of the frame is substantially perpendicular to the second side of the frame.

6. The sealing system of claim 4, further comprising a transfer system positioned between the first sealing system module and the second sealing module, the transfer system transferring motion from the actuator of the first sealing module to the actuator of the second sealing module.

7. The sealing system of claim 4, wherein, the first sealing module is connected to a first anchor, the second sealing module is connected to a second anchor, one of the first sealing module and the second sealing module includes a corner adaptor, and in an engaged configuration of the seal activation system, the corner adaptor forming a seal between the first anchor and the second anchor.

8. The sealing system of claim 2, wherein in an engaged configuration of the seal activation system, the anchor of each of the plurality modules respectively extends into one or more slots within the panel to prevent movement of the panel relative to the frame.

9. The sealing system of claim 2, wherein the seal activation system includes a control member and a pair of opposing slides;

movement of the control member along a first axis moves the opposing slides along a second axis different than the first axis;

the opposing slides respectively attached to an actuator of a first sealing module and an actuator of a second sealing module; and the first and second sealing modules positioned in series on a same side of the frame.

10. The sealing system of claim 1, wherein at least two of the plurality of sealing modules share a common anchor.

11. The sealing system of claim 1, wherein in an engaged configuration of the seal activation system, the anchor of each of the plurality of sealing modules engages one of the panel and frame to form a seal between the panel and the frame.

12. The sealing system of claim 1, wherein the seal activation system includes a control member and a pair of opposing slides;

movement of the control member along a first axis moves the opposing slides along a second axis different than the first axis;

the opposing slides respectively attached to an actuator of a first sealing module and an actuator of a second sealing module.

13. The sealing system of claim 12, wherein one of the control member and the pair of opposing slides includes a pair of slots not parallel to the first or second axis, and the other of the control member and the pair of opposing slides includes a pair of pin respectively extending through the pair of slots.

14. The sealing system of claim 12, further comprising a drive system for moving the control member.

15. A sealing system for providing a seal between a panel and a frame, the sealing system comprising:

a frame;

a panel coupled to the frame;

first and second sealing modules positioned in series in a vertical side of the frame;

a third sealing module positioned in a second horizontal side of the frame perpendicular to the vertical side of the frame;

a transfer device positioned between and connected to the second sealing module and the third sealing module; and a seal activation system positioned between and connected to the first and second sealing modules, wherein each of the first, second, and third sealing modules include:

an anchor for engaging the panel, the anchor movable from a first position to a second position towards the panel, at least one movable member, positioned in the frame, for moving the anchor between the first position and the second position, and an actuator connected to the at least one movable member and for driving the at least one movable member, the actuator moving in a direction perpendicular to a moving direction of the anchor, the seal activation system directly connected to the actuators of the first and second sealing modules.

16. The sealing system of claim 15, wherein:

the seal activation system includes a control member and a pair of opposing slides;

movement of the control member along a first axis moves the opposing slides along a second axis different than the first axis;

the opposing slides respectively attached to the actuators of the first and second sealing modules.

17. The sealing system of claim 15, wherein the panel pivots relative to the frame.

18. The sealing system of claim 15, wherein the transfer system transferring motion from the actuator of the second sealing module to the actuator of the third sealing module.

19. The sealing system of claim 15, wherein the first and second sealing modules share a common anchor.

* * * * *